US009732540B1

(12) United States Patent
Jansen

(10) Patent No.: US 9,732,540 B1
(45) Date of Patent: Aug. 15, 2017

(54) FENCE POST INSTALLATION SYSTEM

(71) Applicant: Mark Edward Jansen, Remer, MN (US)

(72) Inventor: Mark Edward Jansen, Remer, MN (US)

(73) Assignee: Mark Edward Jansen, Remer, MN (US)

( * ) Notice: Subject to any disclaimer, the term of this patent is extended or adjusted under 35 U.S.C. 154(b) by 0 days.

(21) Appl. No.: 15/010,824

(22) Filed: Jan. 29, 2016

Related U.S. Application Data

(60) Provisional application No. 62/133,036, filed on Mar. 13, 2015.

(51) Int. Cl.

| | |
|---|---|
| ***E04H 17/22*** | (2006.01) |
| ***E04H 17/26*** | (2006.01) |
| ***E04H 12/22*** | (2006.01) |
| ***E02D 27/42*** | (2006.01) |

(52) U.S. Cl.
CPC ..... *E04H 17/22* (2013.01); *E02D 27/42* (2013.01); *E04H 12/2215* (2013.01); *E04H 12/2284* (2013.01); *E04H 17/26* (2013.01)

(58) Field of Classification Search
CPC . E04H 12/2284; E04H 12/2215; E04H 17/22; E04H 17/26; E04H 17/261; E04H 17/263; E02D 27/42
USPC ..... 52/741.14, 127.2, 146, 149; 256/35, 36, 256/63, 65.01, 67
See application file for complete search history.

(56) References Cited

U.S. PATENT DOCUMENTS

| | | | | |
|---|---|---|---|---|
| 2,392,549 | A * | 1/1946 | Rice | E04H 17/26 248/49 |
| 4,705,262 | A | 11/1987 | Roberts | |
| 5,061,109 | A | 10/1991 | Miller | |
| 5,104,074 | A * | 4/1992 | Malloy | E04H 12/2215 156/63 |
| 5,192,055 | A * | 3/1993 | Griggs | E04H 17/22 248/354.1 |
| 6,658,753 | B2 | 12/2003 | Tatarnic | |
| 7,377,489 | B1 | 5/2008 | Houseman | |
| 7,726,037 | B1 | 6/2010 | Jordan | |
| 7,946,052 | B2 | 5/2011 | Stevens | |
| 2015/0108318 | A1* | 4/2015 | Orr | F16M 11/32 248/523 |

* cited by examiner

*Primary Examiner* — Brian Glessner
*Assistant Examiner* — Adam Barlow
(74) *Attorney, Agent, or Firm* — Berggren Law Offices, LLC; William R. Berggren; Stephen F. Wolf

(57) ABSTRACT

A system of for installing unanchored fence posts accurately with one or two persons comprising tools to align the fence post while it is being set into an anchored state.

20 Claims, 6 Drawing Sheets

FENCE POST INSTALLATION SYSTEM

FIELD OF THE INVENTION

This invention relates to a fence post anchor installation system.

BACKGROUND OF THE INVENTION

There is a need for a fence post anchor installation system that allows one person to easily and precisely install fence post anchors.

Installing fence posts on any type of grade requires at least 2 people and is very difficult to do accurately and quickly. Using existing hand tools, it takes at least 2 people to measure, level, align, and brace the posts. Installers are constantly moving the post, re-aligning, re-leveling, and adjusting braces.

There still is a need for a fence post installation system that is allows one person to easily, accurately, and quickly install fence posts.

Fence post anchors are used for fence posts that are not placed into cement in pre-dug holes but are affixed directly to the ground. The fence post anchors are parts of a fence post that are pressed into the ground and hold fence posts in place without the use of hardening agents such as cement in pre-dug holes on which fence posts are mounted. There are no tools or methods which currently exist to precisely hold a fence post anchor in place during the installation process. You are just jack hammering a free standing post into the ground allowing it to move in any direction. Current methods allow the anchor to move in any direction while being hammered into the ground-installing fence posts on any type of grade currently requires at least 2 people and is very difficult to do accurately and quickly. Typically sections of a fence may go up hill, downhill or be on a flat surface. The installed posts, typically anchored in cement, must be special aligned to permit installation of panels or fence slats supported by horizontal beams that ate affixed to fence posts set at regular distances. The posts must be level, vertically aligned both with the neighboring post and at right angles to the post to permit proper in subsequent attachment of fence panels or slats. In addition, the posts must be spaces properly to permit the subsequent panel or slat installation to occur to provide a fence that is bout function al and visually appealing. Currently this requires at least two people to measure, level, align, and brace the posts using only existing hand tools. The posts are constantly being moved, re-aligned, and re-leveled, and the braces are constantly being adjusted to hold the posts in a desired position until anchoring cement hardens. There is a need for a system that permits accurate fence post installation in an easier manner, preferably by only one person.

There are no tools or methods which currently exist to precisely hold a fence post anchor in place during the installation process. You are just jack hammering a free standing post into the ground allowing it to move in any direction. My invention assures a much more accurate installation of fence post anchors along with time savings. With my tool you can maintain the correct distance between anchors, locate and keep the anchor a precise distance from the property line, and keep the anchor vertically level in both directions and aligned during installation. You also create a level of consistency with each anchor that you cannot achieve with existing devices. Current methods allow the anchor to move in any direction while being hammered into the ground.

SUMMARY OF THE INVENTION

I have invented a system of tools for installing a fence post, either wood or vinyl, and either non-routered or routered. The system for installing a fence post has two aspects, an article aspect and a method aspect. The article aspect, a fence post system, comprises three elements, a horizontal support element, a first brace element, and a first alignment spacer element. The horizontal support element is configured to releasably attach to an unanchored vertical fence post to be anchored in a hole in a ground and with a front side, a left side, a back side and a right side, a horizontal cross-section, a top end and a bottom end configured to be anchored to a ground. The horizontal support element has a rectangular shape and is configured to encompass the horizontal cross-section of the unanchored fence post and having an adjustable horizontal length in at least a first vertical plane containing a fence line that contains the unanchored fence post. The first brace element has an adjustable length, a first end, and a second end, and is configured to have the first end releasably affixed to the horizontal support element and the second end releasably affixed to the ground adjacent to the unanchored fence post to align the fence post vertically in the first vertical plane containing the fence line. The first alignment spacer element has an adjustable length, a first end, and a second end, and the first end is releasably attached to the horizontal support element in a manner configured to securely hold the unanchored fence post vertically in the second vertical plane transverse to the first vertical plane.

I have also invented a method aspect. The method of installing a fence post comprises six steps. The first step is providing an unanchored fence post to be anchored along a predetermined fence line encompassed by a first vertical plane over a series of predetermined holes. The second step is providing the fence post installation system described above. The third step is releasably affixing the horizontal supporting element to the unanchored fence post. The fourth step is positioning the unanchored fence post in a predetermined hole in a predetermined fence line on the ground. The fifth step is releasably affixing the first brace element with an adjusted length to the horizontal support element and to the ground to stabilize the vertical position of the unattached fence post in the first vertical plane that contains the fence line. The sixth step is placing solidifying liquid into the hole to change the unanchored fence post to an anchored fence post while holding the fence post in vertical alignment in a second vertical plane transverse to the first vertical plane until the liquid sets.

Installing fence posts on any type of grade requires at least two people and is very difficult to do accurately and quickly. My system and tools enable 1 person to accurately and quickly install fence posts uphill, downhill, or on flat grade. Without my product it takes at least two people to measure, level, align, and brace the posts using only existing hand tools. You are constantly moving the post, re-aligning, re-leveling, and adjusting braces. It only takes one person to use my components and method to install fence posts. My product is the most accurate, precise, simple, and fast way to install fence posts. Fencing Contractors can cut their labor costs in half or more and also increase accuracy. As a lifelong Homebuilder I originally designed my product and process to be used by fencing contractors, but realized how simple it was to use and how easily a single home owner installer could benefit from my tools and system.

BRIEF DESCRIPTION OF THE DRAWINGS

One or more features or preferred forms of the invention are described in the accompanying drawings. The drawings are described briefly below.

DETAILED DESCRIPTION OF SOME EMBODIMENTS OF THE INVENTION

Figure 1C:
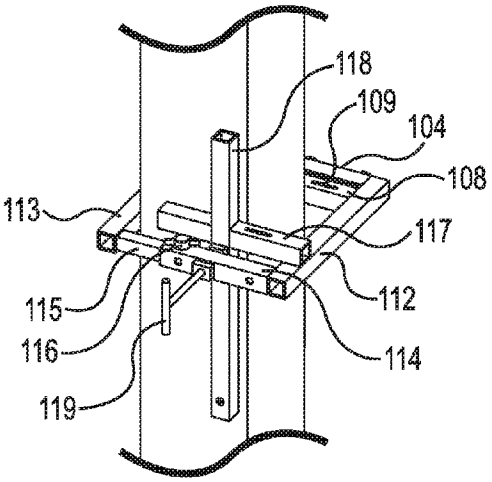
FIG. 1C is an illustration of the embodiment of FIG. 1A showing the horizontal support element on the unanchored fence post from a left rearward perspective.

My invention is a Do-It-Yourself Fence Post Installation System that enables one or two people to install a series of fence posts uphill, downhill, or on a flat surface with accuracy and efficiency. It only takes one or two people to use my components and method to install fence posts. In one embodiment, my system and tools enable just one person to accurately and quickly install fence posts uphill, downhill, or on flat grade.

In addition, my product is the most accurate, precise, simple, and fast way to install fence posts. Fencing contractors can cut their labor costs in half or more and also increase accuracy. As a lifelong homebuilder I originally designed my product and process to be used by fencing contractors, but realized how simple it was to use and how easily a single home owner installer could benefit from some embodiments of my tools and system.

Current fence post installation systems are more time consuming and typically less accurate. Installing fence posts on any type of grade currently requires at least 2 people and is very difficult to do accurately and quickly. Typically sections of a fence may go up hill, downhill or be on a flat surface. The installed posts, typically anchored in cement, must be special aligned to permit installation of panels or fence slats supported by horizontal beams that are affixed to fence posts set at regular distances. The posts must be level, vertically aligned both with the neighboring post and at right angles to the post to permit proper in subsequent attachment of fence panels or slats. In addition, the posts must be spaced properly to permit the subsequent panel or slat installation to occur to provide a fence that is both functional and visually appealing. Currently this requires at least two people to measure, level, align, and brace the posts using only existing hand tools. The posts are constantly being moved, re-aligned, and re-leveled, and the braces are constantly being adjusted to hold the posts in a desired position until anchoring cement hardens. There is a need for a system that permits accurate fence post installation in an easier manner, preferably by only one person.

U.S. Pat. No. 6,658,753 (Tatarnic) attempts to solve this problem with a fence post positioning apparatus. However, Tatarnic has many limitations including two primary ones. First, it does not teach how to easily and accurately install the first fence post in a series. Second it does not teach how to achieve a precise alignment in both vertical planes, one along the fence line and one transverse to that plane.

I have invented a system that does that. In addition, it allows fence posts to be installed more quickly than they are currently, and is suitable for a range of fence post styles and cross-sections. My system is configured to easily and accurately level posts in both vertical directions (facing a neighboring fence post and transverse from that direction), brace posts in both directions, align a post with other posts, locate posts the precise distance off the property line, and measure the exact distance between posts in two places for subsequent precise fence panel installation. The system is used with conventional tools such as levels, measuring tapes and hammers to achieve desired alignment. In addition, with some embodiments, this may be easily done by 1 person.

Specifically, I have invented a system of tools for installing a fence post. The fence posts commonly are either wood or vinyl, and may be either non-routered or routered. Non-routered fence posts have fence post panel supports subsequently affixed to the posts. Routered fence posts have precut holes into which fence panel supports are placed. The system for installing a fence post has two aspects, an article aspect and a method aspect.

The article aspect, a fence post system, comprises three elements, a horizontal support element, a first brace element, and a first alignment spacer element. The horizontal support element is configured to releasably attach to an unanchored vertical fence post to be anchored in a hole in a ground and with a front side, a left side, a back side and a right side, a horizontal cross-section, a top end and a bottom end configured to be anchored to a ground. The horizontal support element has a rectangular shape and is configured to encompass the horizontal cross-section of the unanchored fence post and having an adjustable horizontal length in at least a first vertical plane containing a fence line that contains the unanchored fence post.

Some embodiments of the horizontal support element comprise horizontal front section, a horizontal left side section, a horizontal right side section, and a horizontal back section. The horizontal front section comprises a left end, a right end, a first half, a second half, and a length that extend beyond the side of the unanchored fence post. The horizontal left side section has a first end affixed to the first half of the front section and a second end extending back past the left side of the fence post. The horizontal right side section has a first end affixed to the second half of the front section and a second end extending back past the right side of the fence post. The horizontal back section comprises a left end, a right end, a first half, a second half, and a length that slideably contacts the horizontal left side section and the horizontal right side section. It also comprises an advancing mechanism with a left end affixed to the second end of the horizontal left side section, a right end affixed to the second end of the horizontal right side section, and a screw element in communication with the horizontal back section and configured to be able to move the horizontal back section toward or away from the back side of the fence post.

Fence Posts typically are made of wood or vinyl. The cross-section of common fence posts typically are square and have dimensions ranging from a 2 in. by 2 in. to a 6 in. by 6 in. Most are solid but some have routered holes for two to three cross-members that hold fence slats. In some embodiments the front section and back section of the horizontal support element have left and right parts that are slideably engaged with each other and held in one position with wing nuts. This allows the horizontal support element to be able to fit around fence posts with different cross-sections. In some embodiments the first and second parts are unified and the horizontal support element is configured to releasably affix to fence posts with the same cross-section with only an expandable feature between the front and back sides of the horizontal support element. In some embodiments the front section contains a vertical alignment member to stabilize the horizontal alignment of the horizontal support element when positioned on a fence post to be installed in the ground. In some the back section also is in communication with a vertical alignment member for still more stable alignment. In some embodiments either the front or back section has a slit on its top surface and in some embodiments both have a slit on the top surface to affix to the alignment spacer elements. In some embodiments, the vertical alignment members are affixed to horizontal bars that may be either affixed to the horizontal support element or releasably affixed to it.

The first brace element has an adjustable length, a first end, and a second end, and is configured to have the first end releasably affixed to the horizontal support element and the second end releasably affixed to the ground adjacent to the unanchored fence post to align the fence post vertically in the first vertical plane containing the fence line. In some embodiments the second end is a rotatable stake suitable for pressing into the ground.

The first alignment spacer element has an adjustable length, a first end, and a second end, and the first end is releasably attached to the horizontal support element in a manner configured to securely hold the unanchored fence post vertically in a second vertical plane transverse to the first vertical plane.

In some embodiments, the fence post system also comprises an offset element to measure a predetermined offset from a previously indicated property line. In some embodiments the offset element includes a "T" bracket flexibly affixed to a lower part of a fence post a few inches above the ground when the post is placed in a predetermined hole of the planned fence line. The top of the "T" may be affixed to the fence post by, for example, a bungee cord. The elongated base of the "T" juts out from the side of the fence post and is market with the distance desired for a predetermined offset.

Several embodiments may be used where the unanchored fence post is the first fence post on a fence line, such as, for example, a corner fence post or a high ground fence post. In some embodiments, a second person may hold the fence post in vertical alignment in the second vertical plane transverse to the first vertical plane holding fence line. In some embodiments, the first alignment spacer element acts as another brace element to hold the fence post vertically in the second vertical plane without the need of a second person and the second end is releasably affixed to the ground.

Several embodiments may be used where the unanchored fence post is adjacent to an anchored fence post. In some embodiments, the first alignment spacer element is configured to keep the proper space between the unanchored fence post and the adjacent properly positioned and anchored fence post. This embodiment further comprises a first horizontal support member that is configured to be flexibly affixed to the top of the anchored fence post at a height similar to that of the height of the horizontal support element on the unanchored fence post. In some embodiments the first horizontal support member comprises (1) a horizontal member configured to be held against the front side of the anchored fence post and having ends that extend beyond the left side and right side of the anchored fence post and (2) a flexibly releasable element configured to hold the horizontal member against the front face of the anchored fence post at a height similar to that of the first horizontal support element on the unanchored fence post. In this embodiment, the second end of the first alignment spacer element is configured to releasably affix to the first horizontal support member on the anchored fence post.

In some embodiments where the unanchored fence post is adjacent to an anchored fence post, the system comprises a second horizontal support member, a third horizontal member, and a second alignment spacer element. The second horizontal support member is configured to flexibly releasably affix to the unanchored fence post at a position near the ground. The third horizontal support member is configured to flexibly releasably affix to the anchored fence post at a position near the ground. The second alignment spacer element has an adjustable length, a first end and a second end, and has a length similar to that of the first alignment spacer element. It is configured to have the first end releasably affix to the second horizontal support member and the second end releasably affix to the third horizontal support member. In some embodiments, the second alignment spacer element is used without either a second horizontal support member, a third horizontal support member, or both horizontal support members. In these cases, the second alignment spacer element merely rests on the ground between the two fence posts at either the first end, the second end, or both ends.

In some embodiments where a routered fence post is used, the fence post installation system comprises a second brace element. The routered fence post must be kept suspended above the bottom of a fence post hole while the fence post is anchored to keep the lowest routered hole properly positioned above ground for the subsequent panel installation. The second brace element has an adjustable length, a first end, and a second end, and is configured to have the first end releasably affixed to the horizontal support element on the other side of where the first brace element is affixed, and the second end releasably affixed to the ground adjacent to the unanchored fence post to align the fence post vertically in the first plane that contains a fence line and suspend the bottom of the fence post so that the routered hole is properly positioned above ground for subsequent fence panel installation.

The system may be better understood through use of several illustration s showing several embodiments of the invention. FIG. 1 is an illustration of an embodiment of the invention (100) used for installing an unanchored fence post and with an embodiment of a horizontal support adjustable for use on fence posts of different horizontal cross sections. The above ground portion of an unanchored fence post (A) is shown with a vertical plane in the fence line (101) shown in FIG. 1A. A horizontal support element (102) is shown affixed to the upper portion of the fence post. A first brace element (120), adjustable with connector screw (122) is releasably affixed to horizontal support element 102 to extend outward from its left side along a second vertical plane (123) shown in FIG. 1A and that is transverse to first plane 101, and toward the ground with a stake section (124). A first alignment spacer element (130), adjustable with a connector screw (132) is releasably affixed to horizontal support element 102 to extend outward from its front section toward the ground with a stake section (134). Also shown is a first T-bar element (150) with a protruding arm (152) to show the desired offset from a first property line. T-bar element has protruding arm 152 attached to a first horizontal bar (154) that is releasably affixed to the lower portion of the fence post with an elastic cord (156). A second t-bar element (160 is shown to mark the second property line of a corner of a section of property with a protruding arm (162) attached to a second horizontal bar (164) with a flexible cord (166).

Figure 1B:
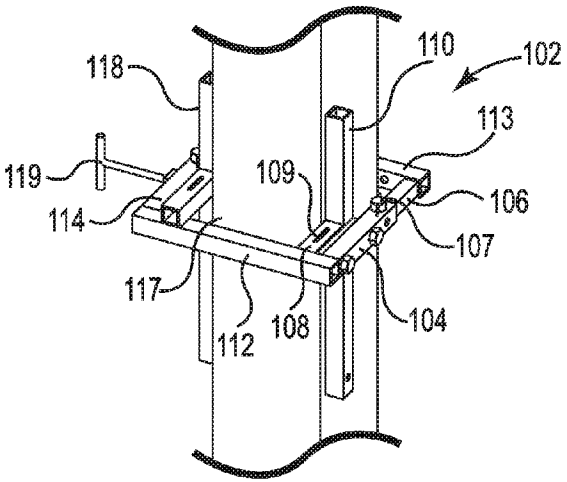
FIG. 1B is an illustration of the embodiment of FIG. 1 showing the horizontal support element on the unanchored fence post from a left forward perspective.
Figure 1:
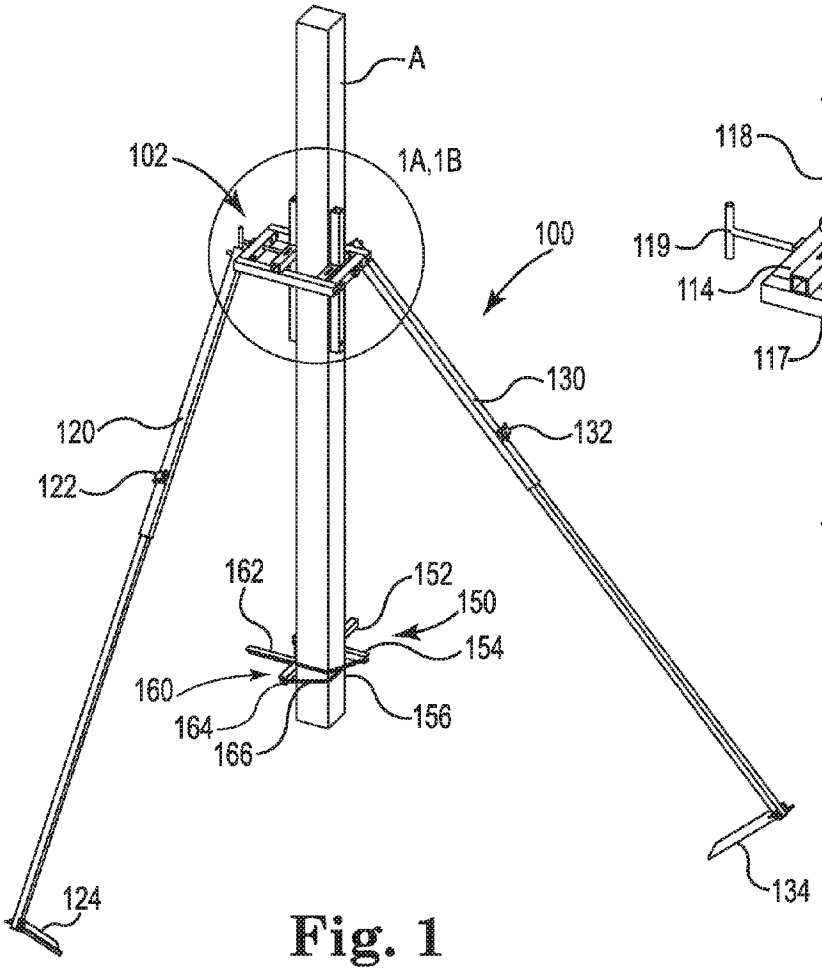
FIG. 1 is an illustration of an embodiment of the invention used for installing an unanchored fence post and with an embodiment of a horizontal support adjustable for use on fence posts of different horizontal cross sections.
Figure 1A:
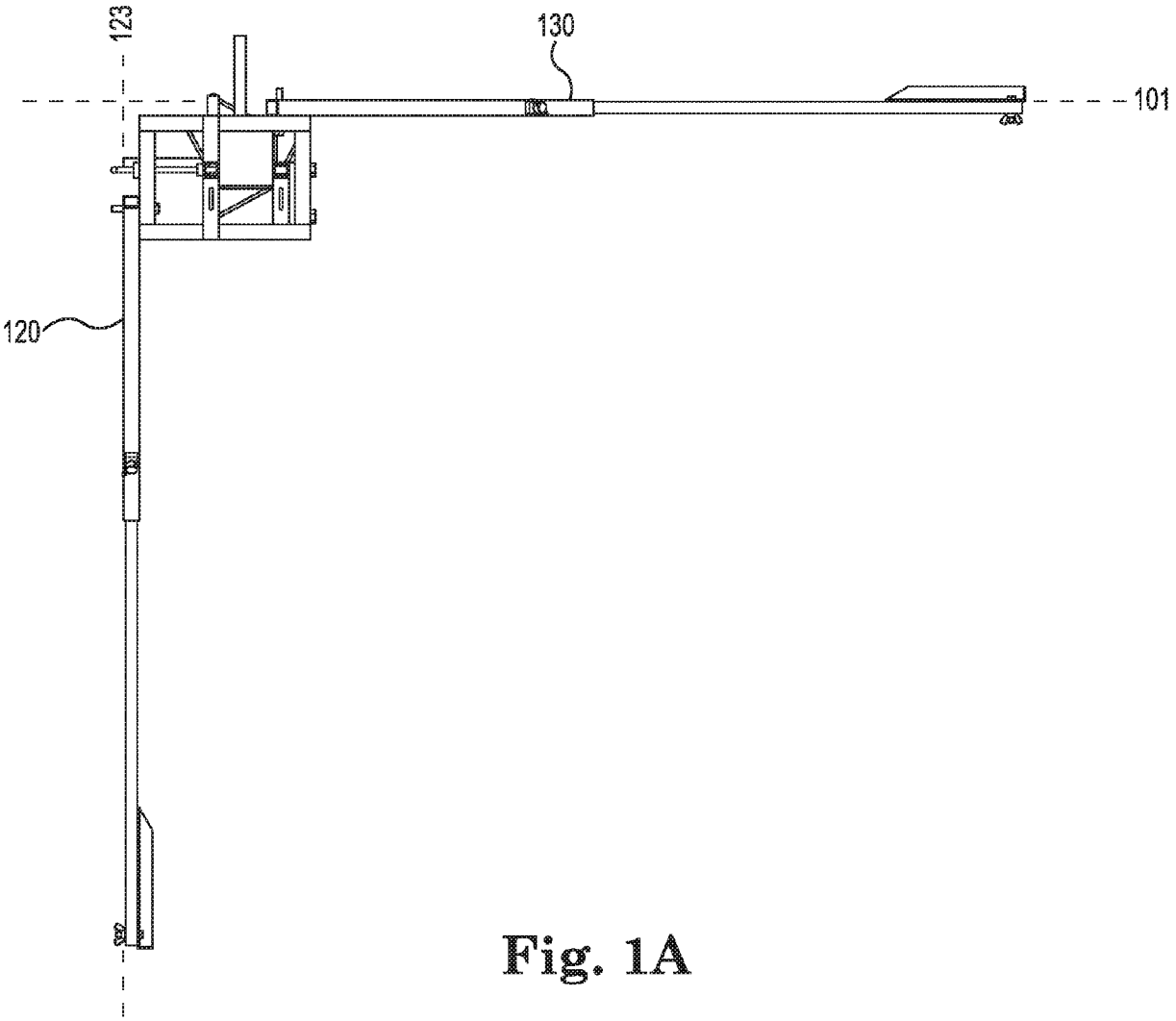
FIG. 1A is an illustration of the top view of the embodiment of FIG. 1 showing the two planes.

FIG. 1A is an illustration of the top view of the embodiment of FIG. 1 showing the two planes. A line view of first vertical plane 101 and second vertical plane 123 is depicted.

FIG. 1B is an illustration of the embodiment of FIG. 1 showing the horizontal support element on the unanchored fence post from a left forward perspective. Horizontal support element 102 is shown with a left front section (104) slideably engaged with a right front section (106), held in place with a connecting screw (107). This embodiment shows a horizontal bar (108) with a slit (109) affixed to a first vertical alignment member (110) and both affixed to left front section 104. A left side section (112) and a right side section (113) are shown affixed to front sections 104, 106. A left back section (114) is releasably engaged with a right back section (not shown) and held with a connecting screw (not shown). An optional second horizontal bar releasably laying over the two side sections 112, 113, is attached to an optional second vertical alignment member and placed between the two back sections and the fence post. A handled screwable shaft (119) is used to press the back sections toward the fence post surface. The resulting horizontal support element is adjustable in both a horizontal line within a first vertical plane that extends from front sections 104, 106 to the back sections 114 and not shown right back section, and also within a vertical plane that that contains the unanchored fence post as positioned along a fence line and a second vertical plane transverse to the first vertical plane.

FIG. 1C is an illustration of the embodiment of FIG. 1A showing the horizontal support element on the unanchored fence post from a left rearward perspective. Here left back section 114 is shown more clearly with a right back section (115) and a connecting screw (116).

Figure 2:
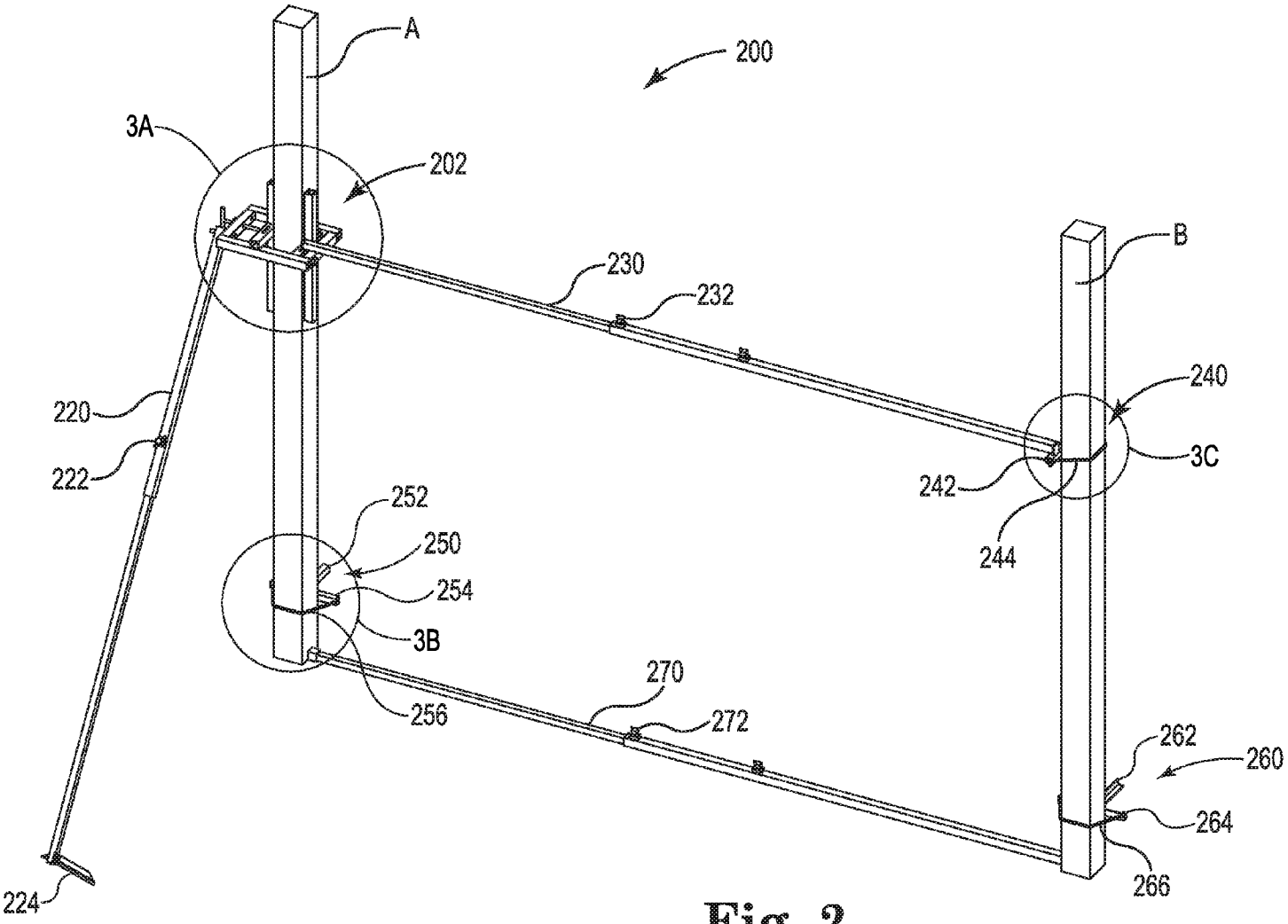
FIG. 2 is an illustration of an embodiment of the invention shown for installing an unanchored second fence post in alignment with an installed anchored fence post and with an embodiment of a horizontal support element fixed for a fence post with a specific cross section.

FIG. 2 is an illustration of an embodiment of an installation system (200) shown for installing an unanchored second fence post in alignment with an installed anchored fence post and with an embodiment of a horizontal support element fixed for a fence post with a specific cross section. The above ground portion of an unanchored fence post (A) and an anchored fence post (B) are shown with a vertical plane in the fence line (201) shown in FIG. 2A. A horizontal support element (202) is shown affixed to the upper portion of fence post A. A first brace element (220), adjustable with connector screw (222) is releasably affixed to horizontal support element 202 to extend outward from its left side along a second vertical plane (223) shown in FIG. 2A and that is transverse to first plane 201, and toward the ground with a stake section (224). First alignment spacer element (230), adjustable with a connector screw (232) is releasably affixed to horizontal element 202 to extend outward from its front section toward the anchored fence post B ground to releaseably affix to a first horizontal support member (240) having a first horizontal member (242) affixed to anchored fence post B at a similar height on anchored fence post B as horizontal support element 202 is on unanchored fence post A. First horizontal member 242 is affixed to anchored fence post B with a flexible cord (244) such as a bungee cord. Also shown is a first T-bar element (250) with a protruding arm (252) to show the desired offset from a first property line. T-bar element has protruding arm 252 attached to a horizontal bar (254) that is releasably affixed to the lower portion of the fence post with an elastic cord (256). A second T-bar element (260) is shown on the lower portion of anchored fence post B to mark also the first property line of a fence line with a protruding arm (262) attached to a horizontal bar (264) with a flexible cord (266). A second alignment spacer element (270) is shown on the ground between the unanchored fence post A and the anchored fence post B. Optionally a second horizontal member could be flexibly releasably affixed to the bottom of unanchored fence post A and a third horizontal support member could be flexibly releasably affixed to the bottom of anchored fence post B. Both ends of the second alignment spacer element are releasably affixed to second horizontal member and third horizontal member in the same manner as the second end of first alignment spacer 102 is releasably affixed to first horizontal member 240.

Figure 2A:
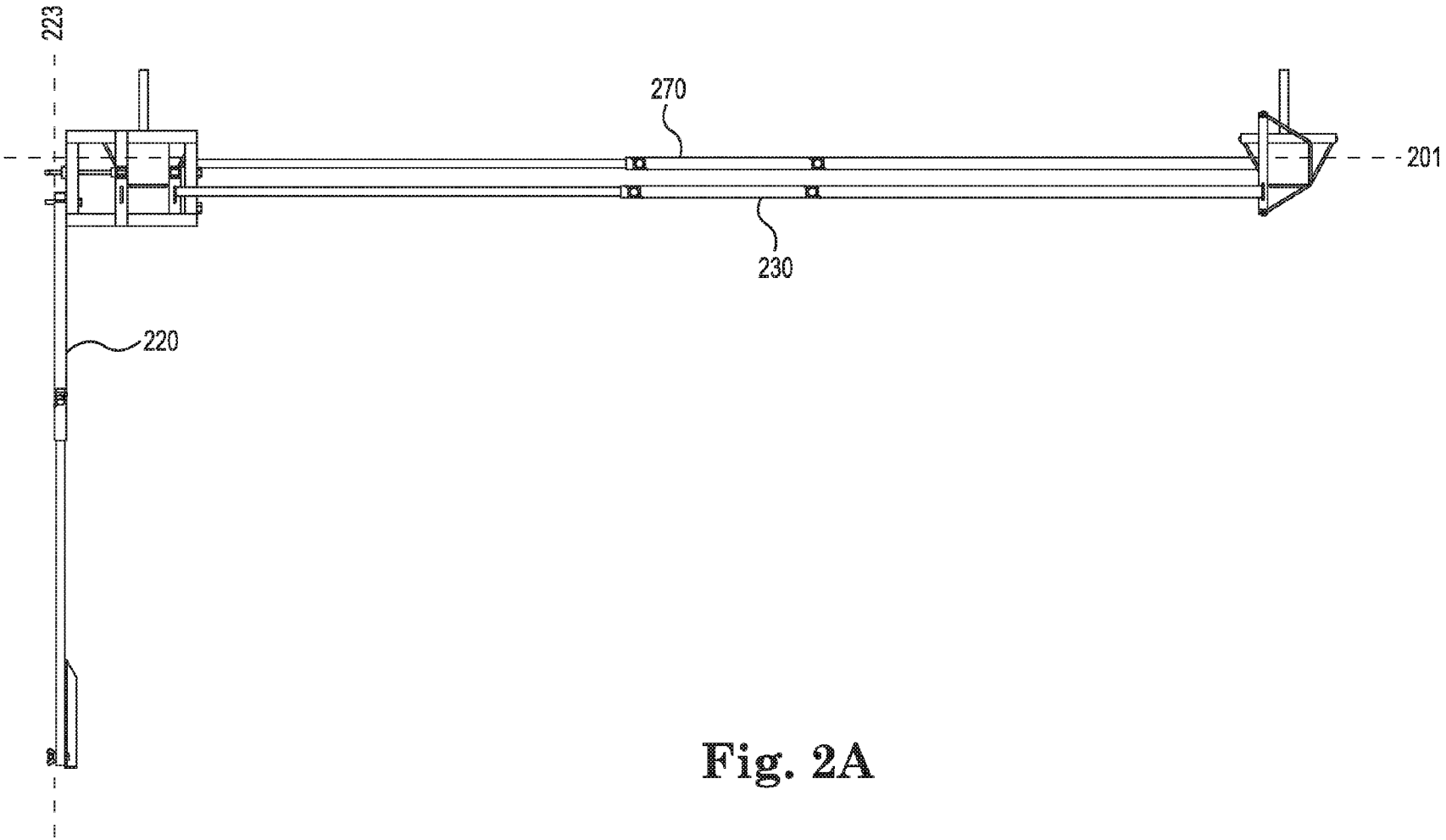
FIG. 2A is an illustration of the top view of the embodiment of FIG. 2 showing the two planes.

FIG. 2A is an illustration of the top view of the embodiment of FIG. 2 showing the two planes. A line view of first vertical plane 201 and second vertical plane 223 is depicted.

Figure 3C:
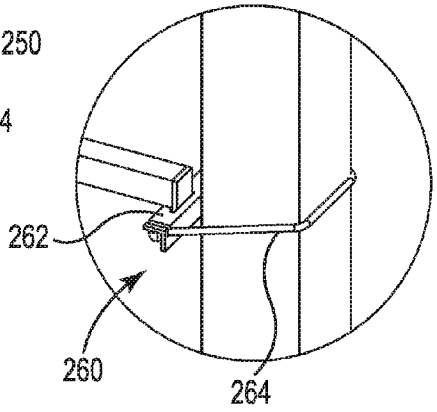
FIG. 3C is an illustration of the embodiment of FIG. 2 showing a horizontal support member flexibly releasably mounted to the anchored fence post.
Figure 3B:
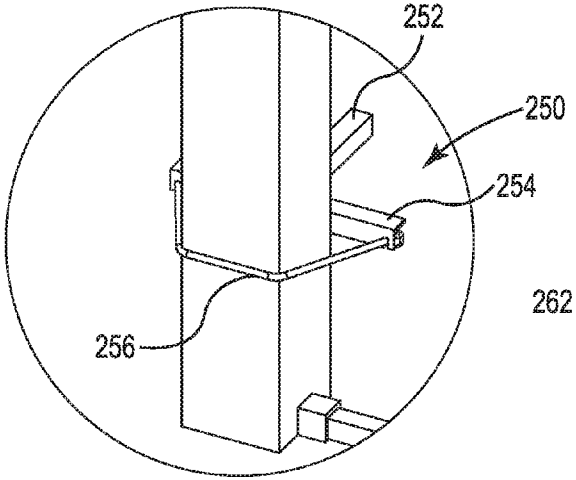
FIG. 3B is an illustration of the embodiment of FIG. 2 showing a t-bar for determining the offset of the unanchored fence post from the property line.
Figure 3A:
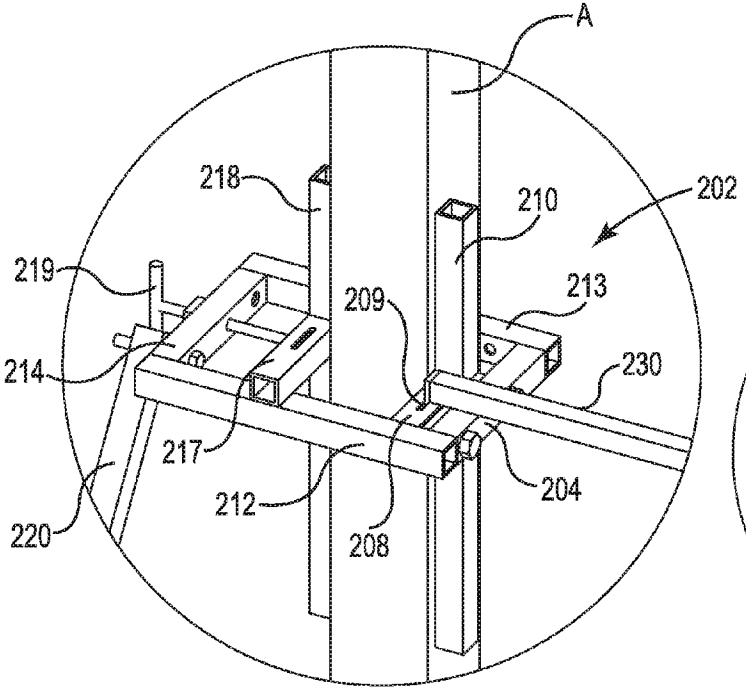
FIG. 3A is an illustration of the embodiment of FIG. 2 showing the horizontal support element mounted to the unanchored fence post from a left forward perspective.

FIG. 3A is an illustration of the embodiment of FIG. 2 showing the horizontal support element mounted to unanchored fence post A from a left forward perspective. Horizontal support element 202 is shown with a front section (204). This embodiment shows a horizontal bar (208) with a slit (209) affixed to a vertical alignment member (210) and both affixed to left part of front section 204. Left side section (212) and right side section (213) are shown affixed to front section 204. A back section (214) is shown. An optional second horizontal bar (217) releasably laying over the two side sections 212, 213, is attached to an optional second vertical alignment member (218) and placed between back section 214 and unanchored fence post A. A handled screwable shaft (219) is used to press back section 214 toward the fence post surface. The resulting horizontal support element is adjustable in a horizontal line within a first vertical plane that extends from front sections 204, 206 to the back sections 214 and not shown right back section, and also within a vertical plane that that contains the unanchored fence post as positioned along a fence line.

FIG. 3B is an illustration of the embodiment of FIG. 2 showing a T-bar element (250) for determining the offset of the unanchored fence post A from the property line. T-bar element 250 has a protruding arm (252) attached to a horizontal bar (254) that is releasably affixed to the lower portion of the fence post with an elastic cord (256)

FIG. 3C is an illustration of the embodiment of FIG. 2 showing a first horizontal support member (260) flexibly releasably mounted to anchored fence post B. First horizontal support member 260 is shown with a horizontal support (262), and a flexible cord (264) releasably holding the horizontal bar to the anchored fence post.

Figure 4A:
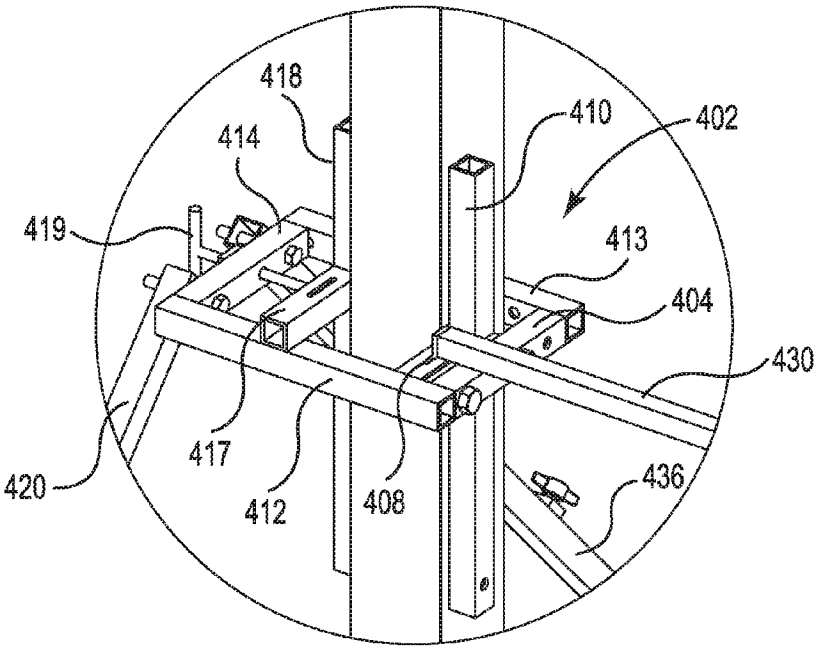
FIG. 4A is an illustration of the embodiment of FIG. 4 showing the horizontal support element mounted to the unanchored fence post from a left forward perspective While the invention is amenable to various modifications and alternative forms, specifics thereof have been shown by way of example in the drawings and will be described in detail below. It is to be understood, however, that the intention is not to limit the invention to the particular embodiments described. On the contrary, the invention is intended to cover all modifications, equivalents, and alternatives falling within the scope of the invention as defined by the appended claims.
Figure 4:
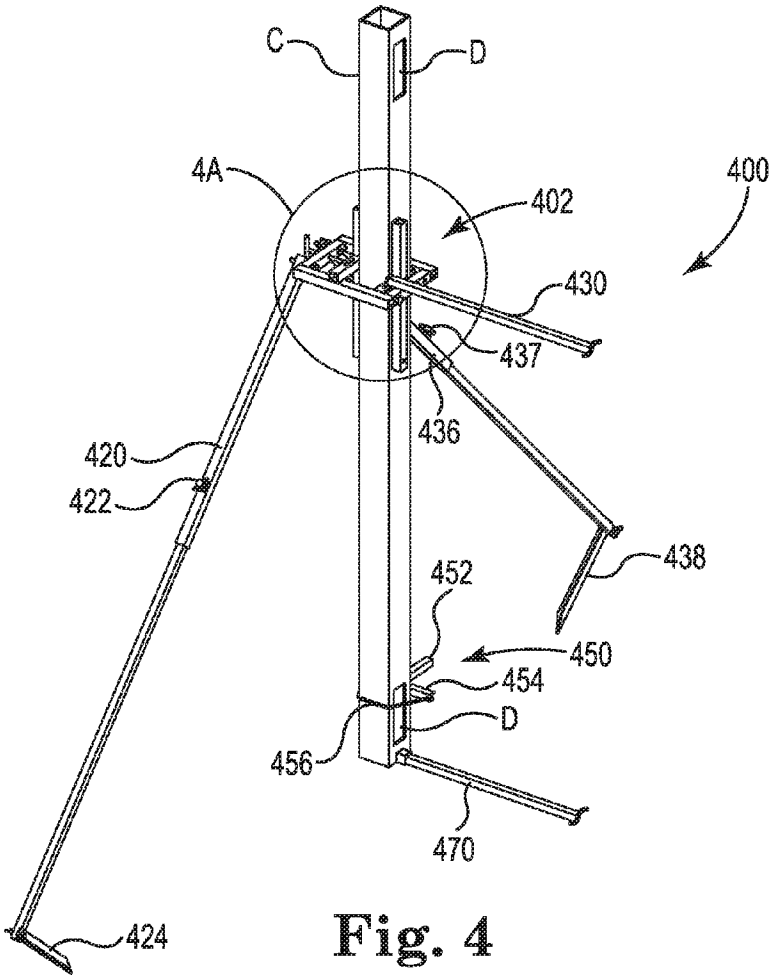
FIG. 4 is an illustration of an embodiment of the invention used for installing an unanchored routered fence post and with an embodiment of a horizontal support adjustable for use on fence posts of a specific horizontal cross section.

FIG. 4 is an illustration of an embodiment of the invention used for installing an unanchored routered fence post and with an embodiment of a horizontal support adjustable for use on fence posts of a specific horizontal cross section. In the figure, a fence post installation system (400) is shown mounted on an unanchored routered fence post C that is shown above ground and with two routered holes D, and with a vertical plane in the fence line (401) similar to what is shown in FIG. 2A. A horizontal support element (402) is shown affixed to the upper portion of routered fence post C. A first brace element (420), adjustable with connector screw (422) is releasably affixed to horizontal support element 402 to extend outward from its left side along a second vertical plane (423) similar to what is shown in FIG. 2A and that is transverse to first plane 401, and toward the ground with a stake section (424). A first alignment element (430), adjustable with a connector screw (432) is releasably affixed to horizontal element 402 to extend outward from its front section toward to anchored fence post B. A second brace element (436), adjustable with connector screw (437) is releasably affixed to horizontal support element 402 to extend outward from its right side toward the ground with a stake section (438). In this manner, the fence post may be suspended above the bottom of the hole in the ground to a height that is proper for the bottom router hole while the fence post is anchored with material such as quick setting liquid, a task normally done by a person holding the router fence post at a suspended distance for the time it takes for the quick drying liquid to set. Also shown is a first T-bar element (450) with a protruding arm (452) to show the desired offset from a first property line. T-bar element has protruding arm 452 attached to a horizontal bar (454) that is releasably affixed to the lower portion of the fence post with an elastic cord (456). A second alignment spacer element (470) is shown on the ground between the unanchored fence post A and the anchored fence post B.

FIG. 4A is an illustration of the embodiment of FIG. 4 showing the horizontal support element mounted to the unanchored fence post from a left forward perspective. Horizontal support element 402 is shown with a front section (404). This embodiment shows a horizontal bar (408) with a slit (409) affixed to a first vertical alignment member (410) and both affixed to left part of front section 404. Left side section (412) and right side section (413) are shown affixed to front section 404. A back section (414) is shown. An optional second horizontal bar (417) releasably laying over the two side sections 412, 413, is attached to an optional second vertical alignment member (418) and placed between back section 414 and unanchored fence post A. A handled screwable shaft (419) is used to press back section 414 toward the fence post surface. The resulting horizontal support element is adjustable in a horizontal line within a first vertical plane that extends from front sections 404, 406 to the back sections 414 and not shown right back section, and also within a vertical plane that that contains the unanchored fence post as positioned along a fence line.

I have also invented a method aspect. The method of installing a fence post comprises six steps. The first step is providing an unanchored fence post to be anchored along a predetermined fence line encompassed by a first vertical plane over a series of predetermined holes. The second step is providing the fence post installation system described above. The third step is releasably affixing the horizontal supporting element to the unanchored fence post. The fourth step is positioning the unanchored fence post in a predetermined hole in a predetermined fence line on the ground. The fifth step is releasably affixing the first brace element with an adjusted length to the horizontal support element and to the ground to stabilize the vertical position of the unattached fence post in the first vertical plane that contains the fence line. The sixth step is placing solidifying liquid into the hole to change the unanchored fence post to an anchored fence post while holding the fence post in vertical alignment in a second vertical plane transverse to the first vertical plane until the liquid sets.

Some embodiments of the method also comprise a seventh step. The seventh step is adjusting the length to a predetermined distance and releasably affixing the first alignment spacer element in the first vertical plane to also hold the fence post in vertical alignment in the second plane and avoid needing a person to hold the fence post during setting of the liquid.

Some embodiments of the method also comprise a eighth and ninth step. The eighth step is providing an anchored fence post with a front side facing the unanchored fence post. The ninth step is providing a providing a fence post installation system that further comprises a fourth tool that comprises a first horizontal support member configured to flexibly releasably affix to an anchored fence post. In this embodiment, the second end of the first alignment spacer element is releasably affixed to both the first horizontal member and the first horizontal support member, and the length is adjusted to a predetermined distance.

Some embodiments of the method further comprise steps tenth through thirteen. The tenth step is providing a fence post installation system that further comprises three additional tools. The fifth tool is a second horizontal support member configured to flexibly releasably affix to the unanchored fence post at a position near the ground. The sixth tool is a third horizontal support member configured to flexibly releasably affix to the anchored fence post at a position near the ground. The seventh tool is a second alignment spacer element having an adjustable length, a first end, and a second end, and is configured to have a length similar to that of the first alignment spacer element with the first end releasably affixed to the second horizontal support member and the second end releasably affixed to the third horizontal support member. The eleventh step is adjusting the length of the second alignment spacer element to one similar to that of the first alignment spacer element. The twelfth step is releasably affixing the second alignment spacer element to the second horizontal support member and the third horizontal support member. The thirteenth step is fine-tuning the position of the unanchored fence post to achieve desired position of the fence post in the hole and vertical alignment in both the first vertical plane and the second vertical plane before placing the solidifying liquid in the hole. Fine-tuning is assisted with use of one or more conventional levels, tape measures, and hammers to achieve satisfactory alignment of the fence post before the unanchored fence post is anchored.

Some embodiments of the method further comprise steps fourteen and fifteen. The fourteen step is providing a fence post installation system that includes an eighth tool. The eighth tool includes at least one T-bar element with the top of the "T" releasably affixed to the fence post near its bottom to mark an offset from at least one property line. The fifteenth step is adjusting the position of the unanchored fence post to a predetermined offset from a predetermined property line.

Some embodiments of the method are variations of the previous embodiment. A second T-bar element with the top of the "T" releasably affixed to the fence post near its bottom is used to mark an offset from a second property line and the adjusting step is to predetermined offsets from two predetermined property lines.

Some embodiments of the method also comprise a sixteenth, seventeenth, and eighteenth step wherein the fence post provided is a routered fence post. The sixteenth step is providing a fence post installation system further comprising another tool. The ninth tool is a second brace element having an adjustable length, a first end, and a second end, and configured to have the first end releasably affixed to the first horizontal support element on the other side of where the first brace element is affixed, and the second end releasably affixed to the ground adjacent to the unanchored fence post to align the fence post vertically in the first plane that contains a fence line and position the unanchored fence post at a satisfactory height to place the lowest routered hole at a predetermined distance above the ground for subsequent panel installation. The seventeenth step is applying the second brace element to suspend the routered fence post in the hole with the lowest routered hole at a predetermined distance above the ground. The eighteenth step is placing solidifying liquid into the hole to change the unanchored fence post to an anchored fence post while holding the fence post in vertical alignment in the second plane transverse to the first vertical plane until the liquid sets if a first alignment spacer element is not used.

Some embodiments of the invention do not need a second brace element during installation of a routered fence post. Instead, a first brace and a first alignment spacer element are used with a person holding the fence post in place of the second brace element.

Some embodiments of the method further comprise variation on the previously described embodiment that includes a nineteenth step. This step is adjusting the length to a predetermined distance and releasably affixing the first alignment spacer in the second vertical plane to also hold the fence post in vertical alignment in the second plane and avoid needing a person to hold the fence post during setting of the liquid. The only tools I've seen people use to install fence posts are the old basics like one or two tape measures, a level, a square, a hammer, wood stakes and braces, and their eyeball. It takes a great deal of time for two or three people to accurately install fence posts using all these old tools. You still can't install a post as accurately and quickly as you can with my invention using, in some embodiments, only one person. My invention results in the most accurate, precise, simple, and fast way to install fence posts when used with conventional levels, measuring tapes, and hammers. Fencing Contractors can cut their labor costs by up to two hundred percent or more and also increase accuracy.

The embodiments of the tools of my system can be made from either steel or aluminum square tubing, nuts, bolts, and threaded inserts, in such places as, for example, a metal fabrication ship. Plastic materials may also be used if sufficiently durable and rigid.

In the beginning I designed my product to use for setting fence posts, but I realized it could be used for setting all kinds of posts. My system can be used to set posts for pole barns, deck bearing posts, deck railings, walkway railings, car ports, billboards, and signs.

Other modifications and changes regarding my invention will be apparent to those skilled in the art. The invention is not considered limited to the embodiments chosen for purposes of disclosure and covers all changes and modifications that do not constitute departures from the true spirit and scope of this invention.

I claim:

1. A fence post installation system comprising:

a horizontal support element configured to releasably attach to an unanchored vertical fence post along a fence line, the horizontal support element comprising a front side, a left side, a back side, and a right side, wherein the horizontal support element has a shape configured to encompass the horizontal cross-section of the unanchored fence post, and wherein the horizontal support element has an adjustable horizontal length in at least a first vertical plane, the first vertical plane containing the unanchored fence post and the fence line;

a first brace element having an adjustable length and having two ends, the first brace element configured to have one end releasably affixed to the horizontal support element and the other end releasably affixed to ground adjacent to the unanchored fence post, wherein the first brace element is configured to align the fence post vertically in the first vertical plane;

a first alignment spacer element having an adjustable length and two ends, wherein one end is releasably attached to the horizontal support element in a manner configured to securely hold the unanchored fence post vertically in a second vertical plane transverse to the first vertical plane; and at least one T-bar element with the top of the "T" releasably affixed to the fence post configured to mark an offset from at least one property line adjacent the fence line.

2. A fence post installation system comprising:

a horizontal support element configured to releasably attach to an unanchored fence post along a fence line, the horizontal support element comprising a front side, a left side, a back side, and a right side, wherein the horizontal support element has a shape configured to encompass the horizontal cross-section of the unanchored fence post, and wherein the horizontal support element has an adjustable horizontal length in at least a first vertical plane, the first vertical plane containing the unanchored fence post and the fence line;

a first brace element having an adjustable length and having two ends, the first brace element configured to have one end releasably affixed to the horizontal support element and the other end releasably affixed to ground adjacent to the unanchored fence post, wherein the first brace element is configured to align the fence post vertically in the first vertical plane;

a first alignment spacer element having an adjustable length and two ends, wherein one end is releasably attached to the horizontal support element in a manner configured to securely hold the unanchored fence post vertically in a second vertical plane transverse to the first vertical plane;

wherein the unanchored fence post is adjacent to an anchored fence post having a front side facing the front side of the unanchored fence post of claim 1 in the plane of the fence line, a left side, a right side, and a back side, and wherein the fence post installation system, further comprises:

a first horizontal support member comprising:

a horizontal member configured to be held against the front side of the anchored fence post and having ends that extend beyond the left side and right side of the anchored fence post and a flexibly releaseable element configured to hold the horizontal member against the front face of the anchored fence post at a height similar to that of the first horizontal support element on the unanchored fence post, wherein the second end of the first alignment spacer element is configured to releasably affix to the horizontal support member.

3. The fence post installation system of claim 2, further comprising:

a second horizontal support member configured to flexibly releasably affix to the unanchored fence post at a position near the ground;

a third horizontal support member configured to flexibly releasably affix to the anchored fence post at a position near the ground and; and a second alignment spacer element having an adjustable length, a first end and a second end, and having a length similar to that of the first alignment spacer element, and configured to have the first end releasably affixed to the second horizontal support member and the second end releasably affixed to the third horizontal support member.

4. The fence post installation system of claim 1, wherein the fence post is a routered fence post and the fence post installation system, further comprises: a second brace element having an adjustable length, a first end, and a second end, and configured to have the first end releasably affixed to the horizontal support element on the other side of where the first brace is affixed, and the second end releasably affixed to the ground adjacent to the unanchored fence post to align the fence post vertically in the first plane that contains a fence line.

5. A method of installing a fence post comprising:

providing an unanchored fence post to be anchored along a predetermined fence line encompassed by a first vertical plane over a series of predetermined holes;

providing a fence post installation system, comprising:

a horizontal support element configured to releasably attach to an unanchored vertical fence post to be anchored in a hole in a ground and with a front side, a left side, a back side and a right side, a horizontal cross-section, a top end and a bottom end configured to be anchored to a ground, the horizontal support element having a rectangular shape configured to encompass the horizontal cross-section of the unanchored fence post and having an adjustable horizontal length in at least a first vertical plane containing a fence line that contains the unanchored fence post;

a first brace element having an adjustable length, a first end, and a second end, and configured to have the first end releasably affixed to the horizontal support element and the second end releasably affixed to the ground adjacent to the unanchored fence post to align the fence post vertically in the first vertical plane that contains the fence line; and a first alignment spacer element having an adjustable length, a first end, and a second end, and the first end is releasably attached to the horizontal support element in a manner configured to securely hold the unanchored fence post vertically in a second vertical plane transverse to the first vertical plane, wherein the fence post installation system further comprises:

a first horizontal support member comprising:

a horizontal member configured to be held against the front side of the anchored fence post and having ends that extend beyond the left side and right side of the anchored fence post and a flexibly releaseable element configured to hold the horizontal member against the front face of the anchored fence post at a height similar to that of the first horizontal support element on the unanchored fence post, and wherein the second end of the first alignment spacer element is configured to releasably affix to the horizontal support member;

releasably affixing the horizontal supporting element to the unanchored fence post;

positioning the unanchored fence post in a predetermined hole in a predetermined fence line on the ground;

releasably affixing the first brace element with an adjusted length to the horizontal support element and to the ground to stabilize the vertical position of the unattached fence post in the first vertical plane that contains the fence line; and placing solidifying liquid into the hole to change the unanchored fence post to an anchored fence post while holding the fence post in vertical alignment in the second vertical plane transverse to the first vertical plane until the liquid sets.

6. The method of installing a fence post of claim 5 wherein the horizontal support element comprises:

a horizontal front section comprising a left end, a right end, a first half, a second half, and a length that extend beyond the side of the unanchored fence post;

a horizontal left side section having a first end affixed to the first half of the front section and a second end extending back past the left side of the fence post and a horizontal right side section having a first end affixed to the second half of the front section and a second end extending back past the right side of the fence post and a horizontal back section comprising a left end, a right end, a first half, a second half, a length that slideably contacts the horizontal left side section and the horizontal right side section, and a screw element in communication with the horizontal back section and configured to be able to move the horizontal back section toward or away from the back side of the fence post.

7. The method of installing a fence post of claim 5 further comprising adjusting the length of the first alignment spacer element to a predetermined distance and releasably affixing the first alignment spacer element in the first vertical plane to also hold the fence post in vertical alignment in the second plane and avoid needing a person to hold the fence post during setting of the liquid.

8. The method of installing a fence post of claim 5 further comprising:

providing an anchored fence post with a front side facing the unanchored fence post; and providing a fence post installation system that further comprises a first horizontal support member configured to flexibly releasably affix to an anchored fence post, wherein the second end of the first alignment spacer element is releasably affixed with both the horizontal support element and the first horizontal support member, and the length is adjusted to a predetermined distance.

9. The method of installing a fence post of claim 8 further comprising:

providing a fence post installation system that further comprises:

a second horizontal support member configured to flexibly releasably affix to the unanchored fence post at a position near the ground a third horizontal support member configured to flexibly releasably affix to the anchored fence post at a position near the ground; and a second alignment spacer element having an adjustable length, a first end and a second end, is configured to have a length similar to that of the first alignment spacer element with the first end releasably affixed to the second horizontal support member and the second end releasably affixed to the third horizontal support member;

adjusting the length of the second alignment spacer element to one similar to that of the first alignment spacer element;

releasably affixing the second alignment spacer element to the second horizontal support member and the third horizontal support member; and fine-tuning the position of the unanchored fence post to achieve desired position of the fence post in the hole and vertical alignment in both the first vertical plane and the second vertical plane before placing the solidifying liquid in the hole.

10. The method of installing a fence post of claim 5 further comprising:

providing a fence post installation system of claim 5 that further comprises at least one T-bar element with the top of the "T" releasably affixed to the fence post near its bottom to mark offset from at least one property line; and adjusting the position of the unanchored fence post to a predetermined offset from a predetermined property line.

11. The method of installing a fence post of claim 10 wherein a second T-bar element with the top of the "T" releasably affixed to the fence post near its bottom to mark offset from a second property line and the adjusting step is to predetermined offsets from two predetermined property lines.

12. The method of installing a fence post of claim 5 wherein the fence post provided is a routered fence post and the method further comprises:

providing a fence post installation system that further comprises a second brace element having an adjustable length, a first end, and a second end, and configured to have the first end releasably affixed to the horizontal support element on the other side of where the first brace element is affixed, and the second end releasably affixed to the ground adjacent to the unanchored fence post to align the fence post vertically in the first plane that contains a fence line and the lowest routered hole a predetermined distance above the ground;

applying the second brace element to suspend the routered fence post in the hole and the lowest routered hole a predetermined above the ground; and placing solidifying liquid into the hole to change the unanchored fence post to an anchored fence post while holding the fence post in vertical alignment in the second plane transverse to the first vertical plane and with the lowest routered hole at a satisfactory height for subsequent fence panel installation until the liquid sets if a first alignment spacer element is not used.

13. The method of installing a fence post of claim 12 further comprising adjusting the length to a predetermined distance and releasably affixing the first alignment spacer element in the first vertical plane to also hold the fence post in vertical alignment in the second plane and a desired height for subsequent panel installation, and avoid needing a person to hold the fence post during setting of the liquid.

14. The fence installation system of claim 2, wherein the fence post is a routered fence post and the fence post installation system, further comprises: a second brace element having an adjustable length, a first end, and a second end, and configured to have the first end releasably affixed to the horizontal support element on the other side of where the first brace is affixed, and the second end releasably affixed to the ground adjacent to the unanchored fence post to align the fence post vertically in the first plane that contains a fence line.

15. The fence installation system of claim 2, wherein the horizontal support element comprises:

a horizontal front section comprising a left end, a right end, a first half, a second half, and a length that extend beyond the side of the unanchored fence post;

a horizontal left side section having a first end affixed to the first half of the front section and a second end extending back past the left side of the fence post and a horizontal right side section having a first end affixed to the second half of the front section and a second end extending back past the right side of the fence post; and a horizontal back section comprising a left end, a right end, a first half, a second half, a length that slideably contacts the horizontal left side section and the horizontal right side section, and an advancing mechanism with a left end affixed to the second end of the horizontal left side section, a right end affixed to the second end of the horizontal right side section, and a screw element in communication with the horizontal back section and configured to be able to move the horizontal back section toward or away from the back side of the fence post.

16. The fence installation system of claim 2, wherein the first half and the second half of both the horizontal front section and the horizontal back section are slideably engaged such that the horizontal support element is adjustable along a horizontal line in the first plane and a horizontal line in the second plane.

17. The fence post installation system of claim 2, wherein the first half and the second half of both the horizontal front section and the horizontal back section are unified such that the horizontal support element is adjustable along a horizontal line in the first plane and a horizontal line in the second plane.

18. The fence post installation system of claim 2, wherein the first horizontal support element further comprises a first vertical alignment member affixed to the horizontal front section and configured to be in contact with the front side of the unanchored fence post to hold the first horizontal support element in a more stable horizontal position.

19. The fence post installation system of claim 18, wherein the first horizontal support element further comprises a second vertical alignment member releasably affixed to the horizontal back section and configured to be in contact with the back side of the unanchored fence post to hold the first horizontal support element in a more stable horizontal position.

20. The fence post installation system of claim 2, wherein the unanchored fence post is the first in a fence line and the second end of the first alignment spacer element is releasably affixed to the ground.

* * * * *